US006668689B1

(12) United States Patent
Lai

(10) Patent No.: US 6,668,689 B1
(45) Date of Patent: Dec. 30, 2003

(54) HANDLE FOR HAND TOOLS

(76) Inventor: Ching-Liang Lai, No. 7, Tien-Yang Lane, Tien-Yang Village, Ta-Tsun Hsiang, Changhua Hsien (TW)

( * ) Notice: Subject to any disclaimer, the term of this patent is extended or adjusted under 35 U.S.C. 154(b) by 0 days.

(21) Appl. No.: 10/246,462

(22) Filed: Sep. 19, 2002

(51) Int. Cl.[7] ..... B25B 23/12

(52) U.S. Cl. ..... 81/451; 81/125; 81/489; 335/284

(58) Field of Search ..... 81/489, 451, 125; 7/125, 165; 335/284, 302–306

(56) References Cited

U.S. PATENT DOCUMENTS 5,794,497 A * 8/1998 Anderson ..... 81/451
6,026,717 A * 2/2000 Anderson ..... 81/451
6,026,718 A * 2/2000 Anderson ..... 81/451
6,032,557 A * 3/2000 Anderson ..... 81/451
6,060,801 A * 5/2000 Anderson ..... 81/451
6,325,577 B1 * 12/2001 Anderson ..... 335/284
6,356,176 B1 * 3/2002 Anderson ..... 335/284

* cited by examiner

*Primary Examiner*—D. S. Meislin
(74) *Attorney, Agent, or Firm*—Bacon & Thomas, PLLC

(57) ABSTRACT

A handle for hand tools includes a body and a plug. The body has a front end and a rear end, and a seating hole adapted to hold a hand tool is defined in the front end. An inner cavity is defined in the rear end, and two magnets are mounted in the inner cavity. A magnetizing space and a demagnetizing space are formed between the two magnets and one magnet and a surface of the inner cavity, respectively. The plug is attached to the rear end of the body, and a magnetizing hole corresponding to the magnetizing space and a demagnetizing hole corresponding to the demagnetizing space are defined in the plug. A slot adapted to turn a cup hook is defined in the plug and crosses the magnetizing and the demagnetizing holes. Consequently, the handle has multiple functions.

2 Claims, 5 Drawing Sheets

HANDLE FOR HAND TOOLS

BACKGROUND OF THE INVENTION

1. Field of the Invention

The present invention relates to a handle, and more particularly to a handle that has a capability to magnetize or demagnetize a tip of a hand tool.

2. Description of Related Art

In our daily lives, screws, hooks and bolts are often used to fasten two elements together or hang up objects for different purposes. When screws are used, a screwdriver is used to insert or remove the screws. Because screws are often used in confined spaces, tips of screwdrivers are often magnetized so the screw can be attached to the tip of the screwdriver before inserting the screw into the confined space or can be retrieved if it falls off the tip of the screwdriver.

However, the tip of the screwdriver in some special applications cannot be magnetized. For example, a magnetic tip on a screwdriver may have an adverse effect on sensitive electronic equipment and particularly on integrated circuits.

Consequently, situations exist where a user may need the tip of the screwdriver to be magnetized, and other situations, not magnetized. Having a magnetized screwdriver and a non-magnetic screwdriver for every purpose is not economical.

With reference to FIG. 5, a converting device (70) has been designed to magnetize or demagnetize a tip (742) of a screwdriver (74). A demagnetizing hole (71) and a magnetizing hole (72) are defined in the converting device (70). The shape of the demagnetizing hole (71) is difference with that of the magnetizing hole (72) so the user can distinguish them. Two permanent magnets (73) are mounted parallel to each other inside the converting device (70). One permanent magnet (73) is mounted between the magnetizing hole (72) and the demagnetizing hole (71), and the other is mounted on the opposite side of the magnetizing hole (72). Both permanent magnets (73) have a south pole (not shown) and a north pole (not shown), and the permanent magnets (73) are arranged so the same magnetic poles face each other.

Hence, when the tip (742) of the screwdriver (74) passes into the magnetizing hole (72), the tip (742) is magnetized because small elementary magnets called dipoles of a material of the tip (742) change their physical position when a magnetic field is applied or removed. The magnetic field between the two permanent magnets (73) aligns the dipoles so the tip (742) magnetized.

Similarly, when the tip (742) passes into the demagnetizing hole (71), the magnetic field will break the alignment of the dipoles because the magnetic pole is different from the magnetizing hole (72) so the tip (742) loses its magnetic attraction.

However, the magnetic device (70) has the following shortcomings:

1. The Converting Device (70) may be Lost Easily:

The converting device (70) is very small and can be easily overlooked or mislaid in a cluttered workplace. If the user is not particularly neat, tools and parts may litter the workplace. The converting device (70) is very easily forgotten and lost.

2. Inconvenience in use:

The converting device (70) is an additional accessory for hand tools. The user must spend time to fine the converting device (70) when the user wants to use it. This will be inconvenient.

3. An Additional Cost for the User and the Manufacturer:

If the user wants to have both an assistant handle and a converting device (70), the user must spend more money to buy both of them. Otherwise, the assistant handle and the converting device (70) must be manufactured respectively and need more than two mold sets to carry out the process. The cost will rise.

To overcome the shortcomings, the present invention provides an improved handle with a capability to magnetize hand tools to obviate the aforementioned problems.

SUMMARY OF THE INVENTION

The main objective of the invention is to provide an improved handle with a capability to magnetize or demagnetize the tip of hand tools.

Another objective of the invention is to provide a handle that can assist a user to grip the hand tools better.

A further objective of the invention is to provide a handle that can help the user to turn a cup hook easily.

Other objectives, advantages and novel features of the invention will become more apparent from the following detailed description when taken in conjunction with the accompanying drawings.

DETAILED DESCRIPTION OF PREFERRED EMBODIMENT

Figure 1:
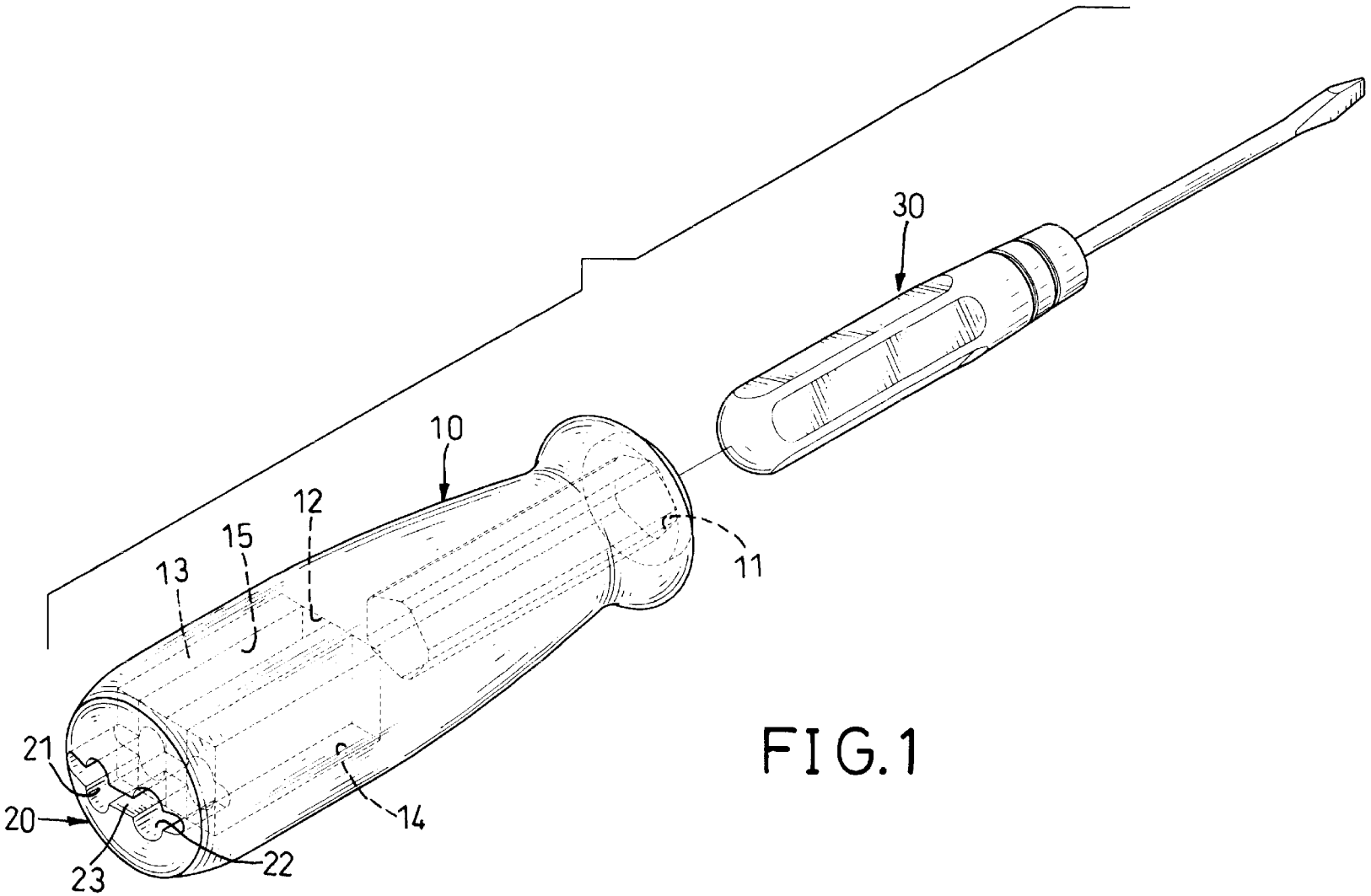
FIG. 1 is a perspective view of a handle in accordance with the present invention.
Figure 2:
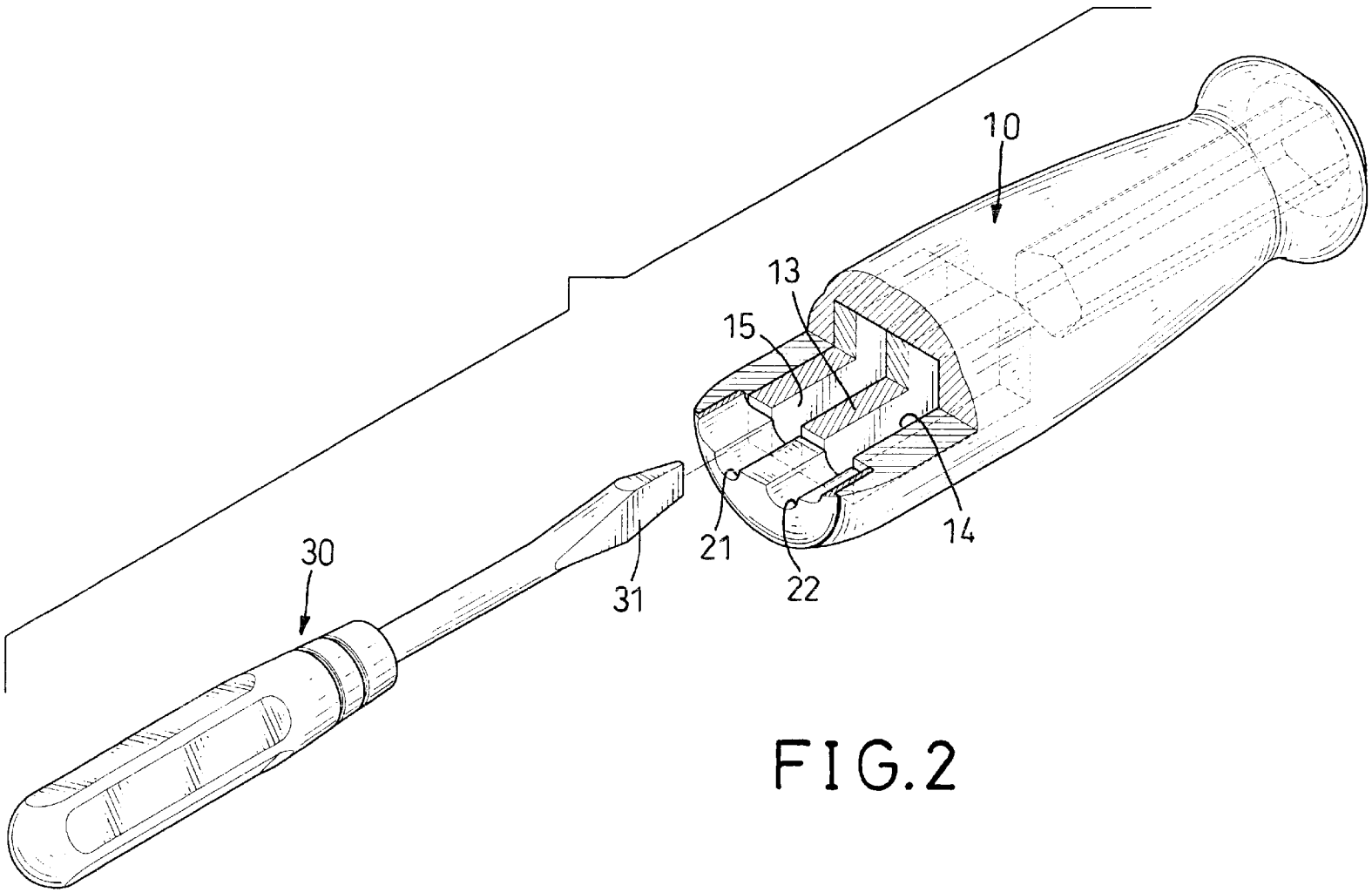
FIG. 2 is a perspective view in partial section of the handle in FIG. 1.
Figure 3:
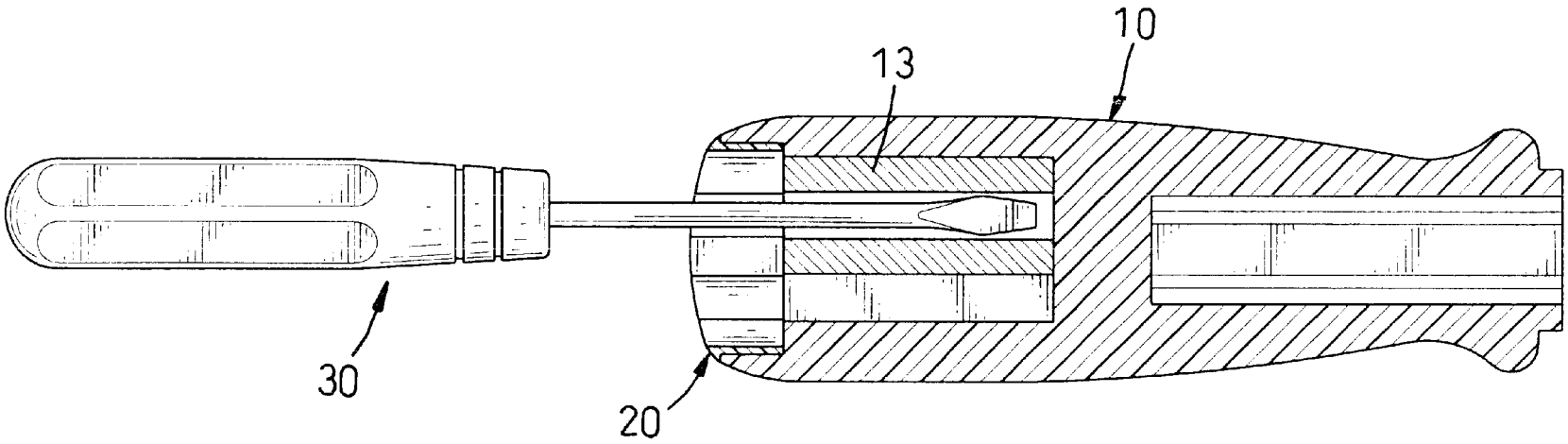
FIG. 3 is an operational side plan view in partial section of the handle in FIG. 1, when the tip of a screwdriver is magnetized.

With reference to FIGS. 1 to 3, a handle (not numbered) in accordance with present invention includes a body (10), two magnets (13) and a plug (20). The body (10) has a front end (not number), a rear end (not numbered), a seating hole (11) and an inner cavity (12). The seating hole (11) is defined longitudinally in the front end. The inner cavity (12) with an inside surface (not numbered) is defined in the rear end. The seating hole (11) is adapted to hold hand tools such as a screwdriver (30). Thus, the handle will help a user grip the screwdriver (30) better, and the screwdriver (30) can be replaceable for different purposes.

The magnets (13) are mounted parallel to each other in the inner cavity (12). Both magnets (13) have a north pole (not numbered) and a south pole (not numbered), and the magnets (13) are arranged so the same magnetic pole faces each other. The inner cavity (12) has a magnetizing space (15) and a demagnetizing space (14). The magnetizing space (15) is formed between the magnets (13). The demagnetizing space (14) is formed between one of the magnets (13) and the surface of the inner cavity (12).

The plug (20) has a slot (23) with a magnetizing hole (21) and a demagnetizing hole (22) and is attached to the end of the body (10) to close the inner cavity (12) in the body (10). The magnetizing hole (21) corresponds to the magnetizing space (15). The demagnetizing hole (22) corresponds to the demagnetizing space (14). Both the magnetizing hole (21) and the demagnetizing hole (22) have an elliptical cross section (not numbered) and are parallel to the magnets (13).

With further reference to FIG. 1, the handle in accordance with present invention can be an assistant handle for the screwdriver (30). The screwdriver (30) can be put into the seating hole (11) so the screwdriver (30) can be gripped better. With further reference to FIG. 2 to 3, the screwdriver (30) has a tip (31). When the tip (31) passes through the magnetizing hole (21) into the magnetizing space (15), the tip (31) will be magnetized because a magnetic force in the magnets (13) acts on and aligns the dipoles of a material of the tip (31) in a same direction. Hence, the tip (31) of the screwdriver (30) is magnetized to meet a user's need.

Similarly, when a magnetized tip (31) passes through the demagnetizing hole (22) into the demagnetizing space (14), the tip (31) is demagnetized. Because the magnetic pole exposed to the demagnetizing space (14) is the opposite of the poles associated the magnetizing space (15), the demagnetizing space (14) is subjected to a different magnetic force and breaks alignment of the dipoles in the material of the tip (31).

Figure 4:
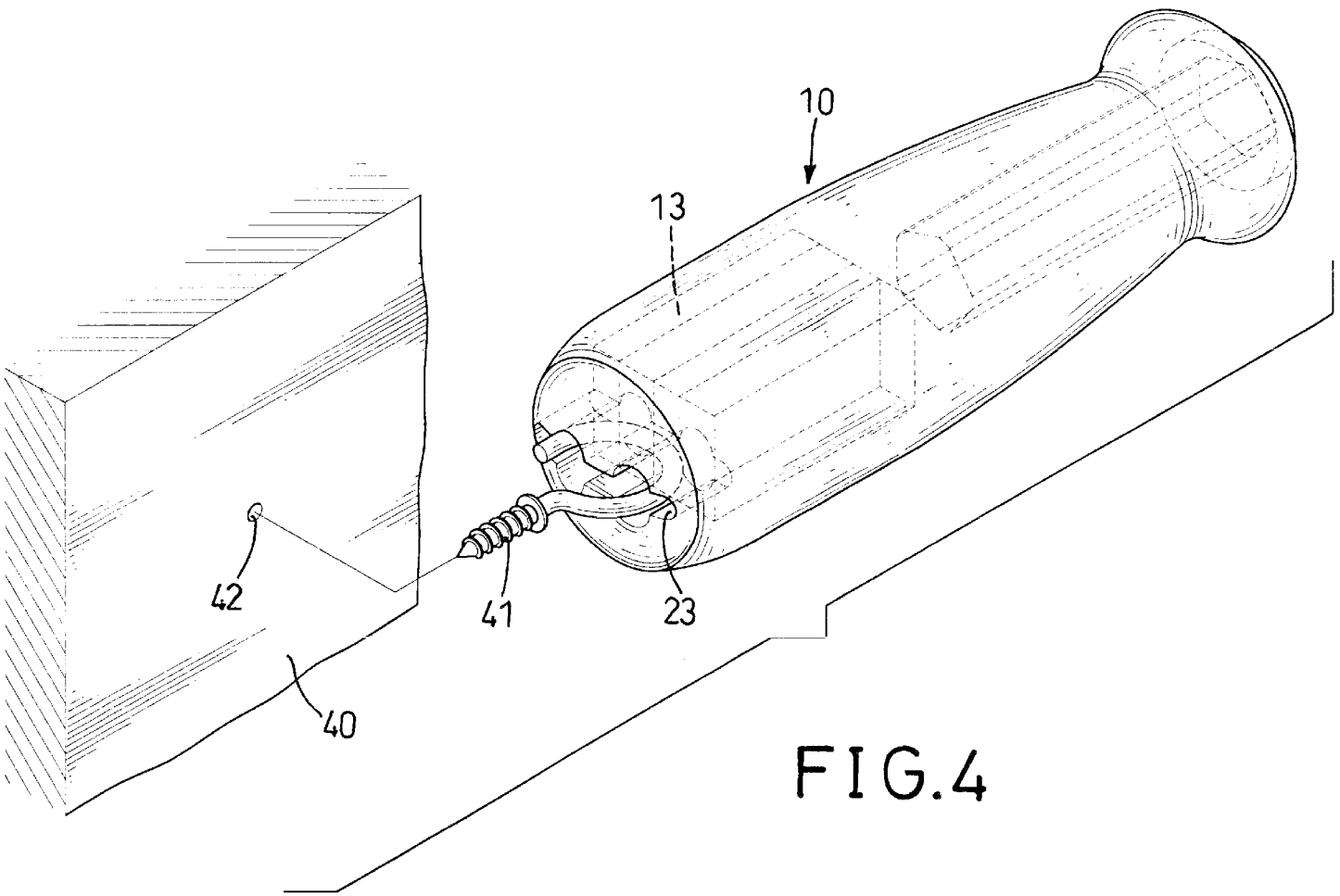
FIG. 4 is an operational perspective view of the handle in FIG. 1, when the handle is used to turn a cup hook.
Figure 5:
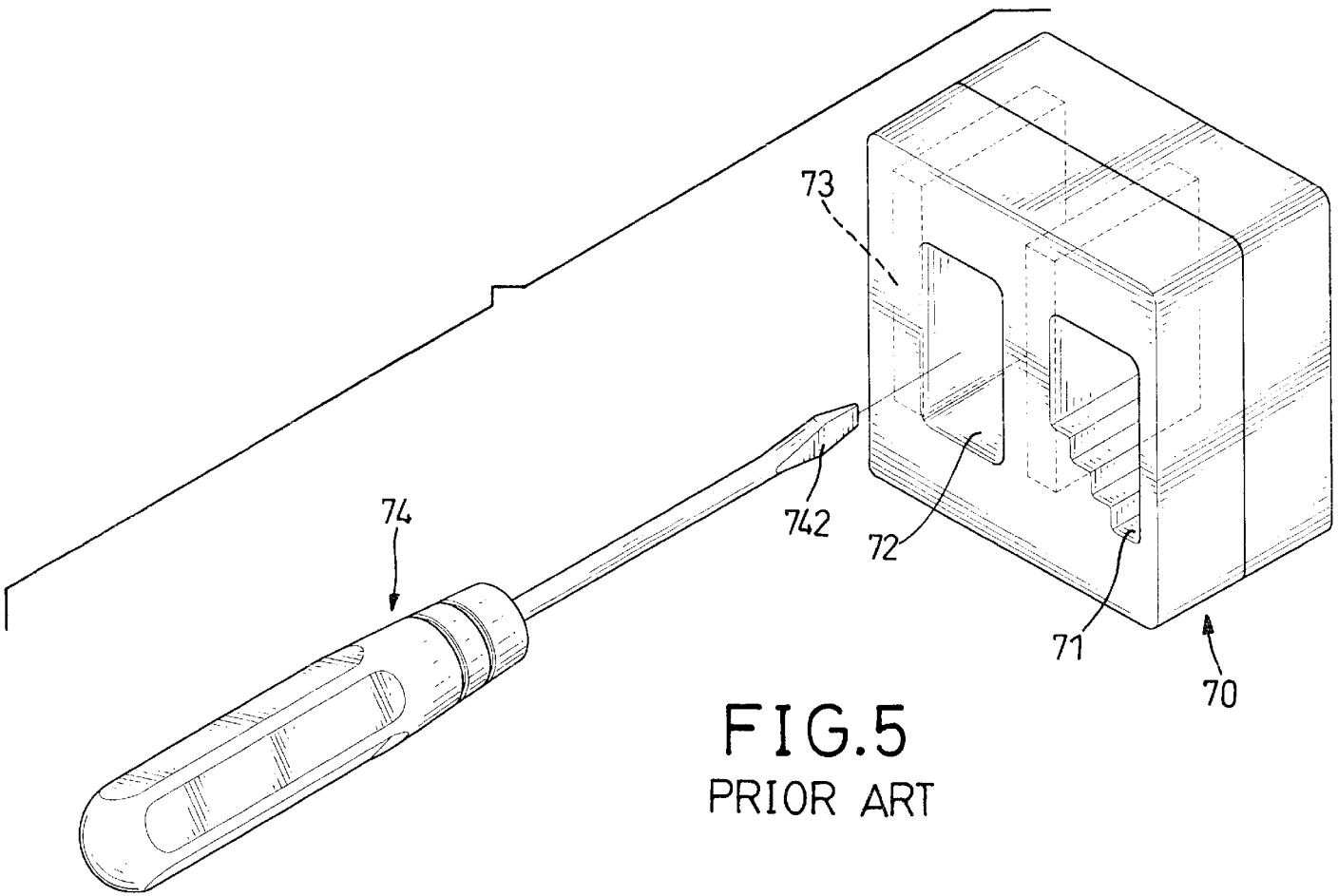
FIG.5 PRIOR ART
FIG. 5 is a perspective view of a conventional converting device for magnetizing or demagnetizing a tip of a hand tool.

With reference to FIG. 4, a cup hook (41) is screwed into a wooden fixture (40) to hang objects in a house. Usually, a guide hole (42) is defined in the wooden fixture (40) so the cup hook (41) can be screwed in easily. When the user wants to screw in a cup hook (41), the slot (23) can hold the cup hook (41) and make it easier to turn without deforming the cut hook (41). The magnets (13) will hold the cup hook (41) in the slot (23), and the user can turn the handle to drive the cup hook (41) into the wooden fixture (40). Using the slot (23) is a simpler and easier way to screw the cup hook (41) than by using hands.

The as described has the following advantages:

1. Not Easy to Lose in a Workplace:

When the user uses hand tools, the handle in accordance with the present invention can be an assistant handle for the hand tools. Thus, every time the user uses the hand tools, the handle is mounted on one of the hand tools. So the probability of losing the handle is lowered.

2. More Convenience in use:

The handle has multiple functions such as being an assistant handle, magnetizing and demagnetizing tips (31) and screwing in cup hooks (41).

3. Saves Money for the User and Reduces the Manufacturing Cost:

Conventionally, an assistant handle and a magnetic device (70) are manufactured separately. Both require a mold set, and the total product cost must be higher. The handle in accordance with the present invention only needs one mold set, and the handle has multiple functions including being an assistant handle and a converting device (70). The user will spend less money.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A handle for hand tools comprising:

a body with a front end and a rear end and the body further comprising:

a seating hole adapted to hold a hand tool defined in the front end;

an inner cavity with a surface defined in the rear end;

two magnets mounted parallel to each other in the inner cavity, and each magnet has a south pole and a north pole with the same pole on the two magnets facing each;

a magnetizing space formed between the two magnets; and a demagnetizing space formed between one of the magnets and the surface of the inner cavity; and a plug attached to the rear end of the body to close the inner cavity, and the plug further comprising:

a magnetizing hole adapted for a tip of the hand tool to pass through the magnetizing hole and the magnetizing hole having an elliptical cross section corresponding to the magnetizing space of the body and defined in the plug;

a demagnetizing hole adapted for the tip of the hand tool to pass through the demagnetizing hole, the demagnetizing hole having an elliptical cross section corresponding to the demagnetizing space of the body and defined in the plug, and the demagnetizing hole parallel with the magnetizing hole; and a slot defined in the plug, and the slot crossing both the magnetizing hole and the demagnetizing hole.

2. The handle as claimed in claim 1, wherein the slot is perpendicular to the magnetizing hole and the demagnetizing hole.

* * * * *